United States Patent [19]

Nishizawa

[11] 4,407,503

[45] Oct. 4, 1983

[54] GOLF PRACTICE DEVICE

[76] Inventor: Hideyuki Nishizawa, 1-5-1, Nakasato-cho, Kita-ku, Tokyo, Japan

[21] Appl. No.: 285,738

[22] Filed: Jul. 22, 1981

[51] Int. Cl.[3] ..... A63B 69/36

[52] U.S. Cl. ..... 273/197 R; 273/195 A

[58] Field of Search ..... 273/197 R, 197 A, 184 B, 273/185 D, 200 B

[56] References Cited

U.S. PATENT DOCUMENTS

| | | | |
|---|---|---|---|
| 1,091,985 | 3/1914 | Thompson et al. | 273/197 R |
| 1,690,158 | 11/1928 | Currie | 273/197 R X |
| 2,641,932 | 6/1953 | Van Kinkle | 273/197 R X |
| 3,815,922 | 6/1974 | Brainard | 273/184 B |
| 4,023,809 | 5/1977 | Newton | 273/184 B |

*Primary Examiner*—George J. Marlo

[57] ABSTRACT

A golf practice device includes a base plate, a support shaft inclined from the vertical and extending upwardly from the base plate, and a golf ball support arm slideably adjustable along the support arm. For the best method of practicing the swing, the length of the support arm and support shaft are such that a golf ball at the end of the support arm may be positioned at a distance between 20 and 40 centimeters above the base plate, where it will be struck by the golfer. Since the support shaft is inclined from the vertical, the support are will always automatically return the golf ball to the same location above the base plate.

1 Claim, 2 Drawing Figures

GOLF PRACTICE DEVICE

SUMMARY OF THE INVENTION

This invention relates to a golf practice device, and more particularly to a golf practice device suitable for practising a proper form of swing.

Recently, the golf has become the general sports for a great many sports fans, but the proficiency is difficult, and a large number of golf ranges are opened for such golf fans or enthusiasts besides the regular golf courses. Moreover, the golfers are usually engaged in golf exercise at homes in addition to the golf ranges so that a wide variety of golf practice devices are sold in markets such as sports goods shops or stores.

The swing of the golf has its object of accurately hitting the golf ball placed on the lawn or teed up, and its practising is required to be ones similar to the golf courses, and all of the golf practice devices, either for homes or golf ranges are constructed in such way that the golf ball is teed up or is placed on the green mat resembling the lawn, and no practice device sold in markets which imitates the condition that never occur in the golf courses. The effect obtained from learning of the proper swing form with a proper use of any of the foregoing golf practice devices is never better than the effect obtained from hitting a good many golf balls in the golf range.

This invention has eliminated the foregoing drawbacks, and its object is to provide a golf practice device producing the condition of the golf ball where which is of relatively small difference from that of the golf course and enabling the user to learn the proper swing form by repeating the hitting exercises.

DETAILED DESCRIPTION OF EMBODIMENT

Figure 1:
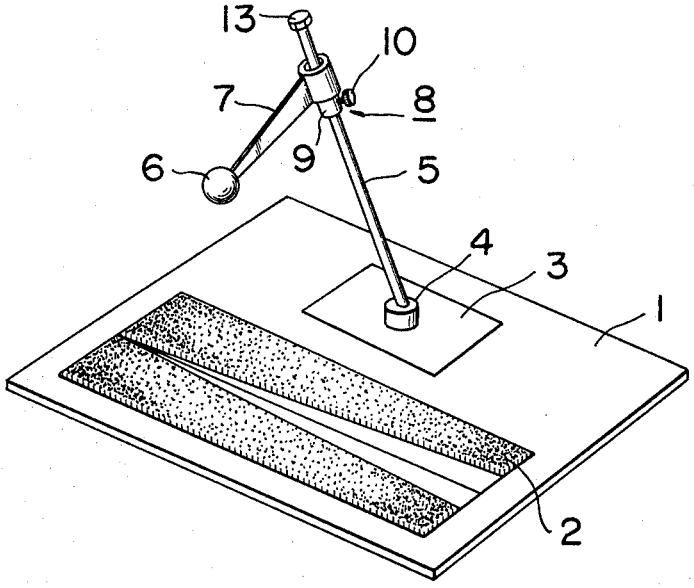
FIG. 1 is a perspective view of the one embodiment of this invention.

With respect to the details of this invention, a description is provided by referring to FIG. 1 showing an embodiment. At one surface of the base plate 1 made of rubber or plastics, a green mat made of an artificial fiber is pasted. Also, a seat plate 3 is provided on the base plate 1, and a support shaft 5 is mounted by means of a support base 4 mounted on the seat plate 3 in such way that its angular position against the seat plate 3 can be changed freely. An arm 7 fixed with the imitation golf ball 6 and an imitation golf ball support 8 are slidably inserted on the support shaft 5, and the imitation golf ball support 8 is arranged to be fixed at an optional position by means of a collar 9 and a screw 10. By the way, at the tip of the support shaft 5, a stopper 10 is fixed to prevent pullout of the imitation golf ball support 8.

Now, the method of use of the golf practice device will be described wherein the support shaft 5 is properly inclined to the direction of the green mat 2, and the imitation golf ball support 8 is fixed by means of the collar 9 and the screw 10 so that the imitation golf ball 6 comes to a proper height position on the green mat 2. When the imitation golf ball 6 is hit by a club, the struck imitation golf ball 6 turns around the support shaft 5 and becomes static at the point when the force is lost, but as the support shaft 5 is inclined toward the green mat 2, the imitation golf ball 6 returns to the upper portion of the green mat 2, namely, the initial start position and becomes static.

In this golf practice device, when the imitation golf ball 6 is supported to about a height near the knee of the user off above the green mat 2, a remarkable effect is provided with respect to an improvement of the swing form. This means that, originally, the swing of the golf resides in the turning of the shaft of the club in the plane including the golf ball as the basic condition, and keeping this condition during a whole movements of the swing is an indispensable condition, and in spite of the fact that the foregoing indispensable condition is well known among the golfers, a good many golfers makes the swing with the form not faithfully to this fundamentals, and such swing brings about unsatisfactory results in the flying distance and the directivity and the like.

The cause resides in that even when the golf ball placed at an ordinary position is hit, a locus of the shaft of the club does not form a plane including the golf ball and the shaft, the collision of the golf ball with the club head is possible. In making the swing, many a golfer only concentrates his mind in hitting the golf ball with the club gripped by hand, and believes that the hitting of the golf ball with force applied to the hand is a method of flying the golf ball far away and ignores the flat shape drawn by the shaft. However, the best method of flying the golf ball to a far location is to transmit the rotating motion of the body without waste of power to the club head, and for this purpose, the minimum condition is to perform the swing at least by maintaining the fore arm of the left art (right arm in case of the left hitter) that grips the club and the grip.

As the best method of practising the swing, the inventor has acquired the fact through his experience that he exercises the hitting of the golf ball in the condition where it is floated from about 20 to 40 cm off the ground. However, even in the case where the swing is perferred after the club head is guided to the golf ball at such position, the locus of the club head in the swing tends to going out of order, and in order to hit the golf ball accurately, the swing must be performed which is faithful to the fundamentals of the golf which keeps the arm to almost stationary and to turn the shoulders and the waist horizontally. Therefore, the hitting exercise of the golf ball is closely connected naturally to the formation of the swing form faithful to the fundamentals of the golf.

Figure 2:
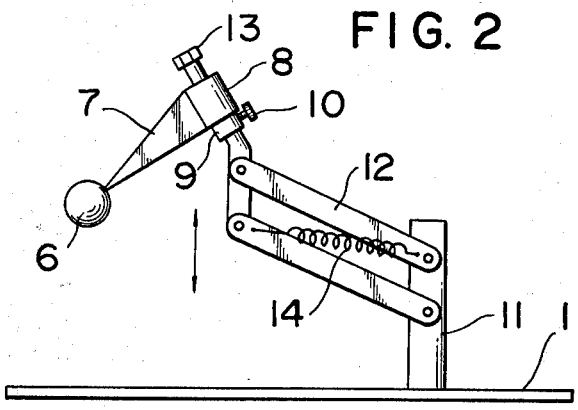
FIG. 2 is a side view of another embodiment of this invention.

FIG. 2 shows another embodiment of this invention, wherein a column 11 is held upright on the base plate 1, and a support shaft 13 is mounted at one side of the column 11 by means of a pantograph 12 from this column 11. The imitation golf ball support 8 having the arm 7 mounted with the imitation golf ball 6 is rotatably inserted into the support shaft 13, and the position can be optionally determined by the collar 9 and the screw 10. Also, the support shaft 13 is inclined to the green mat (not shown). By the way, a spring 14 is spanned between two vertically opposed sides of the pantograph 12 and the pantograph 12 is positioned and set in step mode by a stock pin not shown, and a plurality of through holes provided on any base portion of the upper and lower members of the pantograph and a through hole provided on the column 11.

The first feature of the golf practice device according to this invention is to allow the adjustment of the height of the imitaton golf ball freely from the low position in contact with the green mat to the high position around the knee, and the second feature is to provide the imitation golf ball rotatably on the support shaft inclined to the green mat. With the provision of the foregoing features, the practising can be made while adjusting the position of the imitation golf ball optionally to high or low positions, and thus, the user can learn the hitting of the golf ball at the proper position without putting the correct form of turning the shoulders learnt with the golf ball at the high position into disorder, and remedying the swing form in short times by the repetition exercise, and making it possible to complete the proper golf swing together the directivity and the flying distance, and as the result, the practical effect of this invention is immensely great.

What is claimed is:

1. A golf practice device comprising in combination (a) a base plate, (b) an inclined support shaft extending upwardly from the base plate, (c) a rigid golf ball support arm having an inner end that is mounted on said support shaft so that said ball support arm can slide up and down said inclined support shaft, (d) a golf ball attached to the outer end of the golf ball support arm, (e) means for supporting the inner end of said ball support arm on said support shaft at a distance such that said support arm is freely rotatable around said support shaft and so that the ball can be positioned between 20 and 40 cm above said base plate, (f) said support arm being connected to said support shaft at such an angle that gravitational forces alone will always automatically return said golf ball to exactly the same location above said base plate so that a golfer practicing his golf swing can hit the golf ball any desired number of times without either changing his position or removing his hands from the golf club.

* * * * *